US009198480B1

(12) United States Patent
Junge

(10) Patent No.: US 9,198,480 B1
(45) Date of Patent: Dec. 1, 2015

(54) BUTTON COVER

(71) Applicant: Kathy Eleanor Junge, Woodland Hills, CA (US)

(72) Inventor: Kathy Eleanor Junge, Woodland Hills, CA (US)

( * ) Notice: Subject to any disclaimer, the term of this patent is extended or adjusted under 35 U.S.C. 154(b) by 0 days.

(21) Appl. No.: 14/336,302

(22) Filed: Jul. 21, 2014

(51) Int. Cl.
*A44B 1/08* (2006.01)
*A44B 5/00* (2006.01)
*A44B 1/14* (2006.01)

(52) U.S. Cl.
CPC .. *A44B 5/007* (2013.01); *A44B 1/14* (2013.01)

(58) Field of Classification Search
CPC ..... A44B 1/14; A44B 1/28; A44B 1/32; A44B 1/38; A44B 5/007; Y10T 24/3672; Y10T 24/367; A43C 11/06; A43C 11/08; A43C 11/14
USPC ..... 24/113 R, 113 MP
See application file for complete search history.

(56) References Cited

U.S. PATENT DOCUMENTS 1,774,033 A 8/1930 Myers et al.
2,751,654 A 6/1956 Armbruster
3,316,601 A * 5/1967 Ryan ..... 24/113 R
3,353,231 A * 11/1967 Levine ..... 24/113 R
3,543,354 A * 12/1970 Mitchell, Jr. et al. ..... 24/102 PL
3,934,313 A 1/1976 Hocq
5,060,356 A 10/1991 Szedzinski
5,337,584 A * 8/1994 Angeli ..... 63/1.17
5,394,719 A * 3/1995 Fang ..... 63/33
5,621,951 A * 4/1997 Gould ..... 24/90.5
D475,322 S * 6/2003 Ouellette et al. ..... D11/222
6,857,167 B2 * 2/2005 Bishop ..... 24/66.2
7,389,567 B2 * 6/2008 Rogers et al. ..... 24/113 R
8,726,469 B1 * 5/2014 Delaneau ..... 24/113 R
D720,255 S * 12/2014 Gramatikas ..... D11/222
2004/0226145 A1 * 11/2004 Ouellette et al. ..... 24/113 MP
2008/0244873 A1 * 10/2008 Yamashita et al. ..... 24/90.1
2011/0277502 A1 * 11/2011 Welikson ..... 63/1.18

* cited by examiner

*Primary Examiner* — Robert J. Sandy
*Assistant Examiner* — Rowland Do
(74) *Attorney, Agent, or Firm* — Patentfile, LLC; Bradley C. Fach; Steven R. Kick

(57) ABSTRACT

A button cover providing a decorative covering for buttons on clothing, accessories, and other button substrates. The button cover is configured to slidably engaged over a button and button substrate, and may include: a cover face; a first clip arm connected to the cover face; a second clip arm connected to the cover face; a clip channel located between the first clip arm and the second clip arm; a cover channel located parallel to the clip channel; and a button cavity positioned above the clip channel below the cover face.

11 Claims, 7 Drawing Sheets

BUTTON COVER

FIELD OF THE INVENTION

The present invention relates to the field of button covers. More specifically, the invention relates to ornamental covers that slidably attach to buttons and the substrate to which the button is attached.

BACKGROUND

Various types of ornamental button covers have been known and used to provide decoration to buttons on shirts, blouses, trousers, shoes, and the like. These button covers are typically secured to a button by a clip that is configured to grasp the button and obscure the button behind a decorative façade.

Currently, button covers of this type are employed to simulate the appearance of cufflinks, without requiring the presence of French cuffs on shirts and blouses. The advantage of these button covers, with respect to a traditional cuff link, resides in that they can be used with any kind of shirt or garment, without requiring the characteristic pair of button holes necessary when using cuff links. These button covers may also be attached to other buttons that are not on the sleeves in order to simulate the appearance of more ornate styled buttons.

Unfortunately, button covers in the art all suffer from similar drawbacks. Since these button covers are larger than the buttons to which they attach directly to, these covers are prone to catching on objects which ultimately results in the button cover and button becoming torn from the garment. Not only can a lost button result in uncomfortable social situations for the wearer, but the lost cover and button also cost the wearer in time and replacement expenditures.

Another drawback common to these button covers is their unitary design. If person would like to use a different style of cover or change to style of covers they are currently wearing, the user must maintain a separate set of button covers. Not only do additional sets of covers represent further expense, but they also require storage space should the wear desire to switch them out on the go.

Therefore, a need exists for novel button covers that are able to provide ornamental decoration to buttons on a wide variety of garments. There is a further need for button covers that are able to resist being torn from or tearing the button from the garment or substrate to which they cover. There also exists a need for button covers that have a more consistent substrate that may optionally be manufactured with design variation advantages for a broad range of temporary customization and/or permanent styles. Finally, there exists a need for button covers that are able to interchangeably accept and secure different styles and shapes of ornamental coverings.

BRIEF SUMMARY OF THE INVENTION

In preferred embodiments, the button cover is configured to slidably engage over a button and button substrate, and comprises: a cover face; a first clip arm connected to the cover face; a second clip arm connected to the cover face; a clip channel located between said first clip arm and said second clip arm; a cover channel located parallel to said clip channel; and a button cavity positioned above said clip channel below the cover face; wherein the first and second clip arms are configured to apply pressure to the button substrate temporarily holding the button cover in place over a button. Optionally, ornaments, indicia, and other decorative elements may be permanently or temporarily attached to the cover face.

In further preferred embodiments, the apparatus may comprise an attachment base configured to be permanently or temporarily attached to the cover face and/or cover sidewalls. The attachment base may comprise one or more base sidewalls and a base face. Ornaments, indicia, technological elements, and other decorative elements may be permanently or temporarily attached to the attachment base.

In still further preferred embodiments, the apparatus may comprise a face plate which may also comprise ornaments, indicia, and other decorative elements may be permanently or temporarily attached to the base face and/or to one or more base sidewalls of the attachment base. Optionally, the face plate may attach to the cover face and/or to one or more cover sidewalls.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New button covers are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
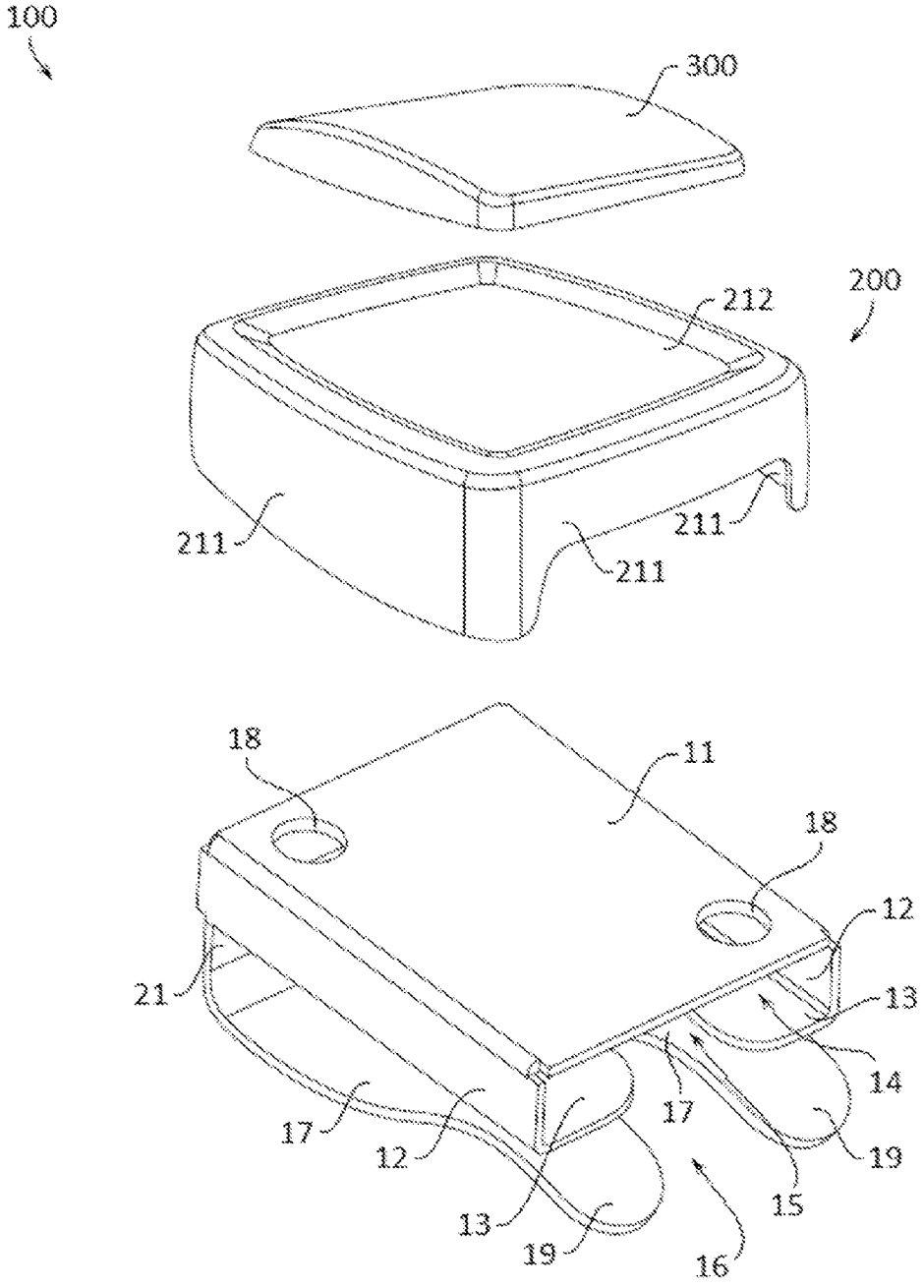
FIG. 1 depicts an exploded perspective view of an example of a button cover apparatus according to various embodiments described herein.

The present invention will now be described by example and through referencing the appended figures representing preferred and alternative embodiments. FIG. 1 illustrates an example of a button cover apparatus ("the apparatus") 100 according to various embodiments. In this example, the apparatus 100 comprises a cover face 11, three cover sidewalls 12, two button arms 13, a button cavity 14, a cover channel 15, a clip channel 16, and two clip arms 17. Also as shown in this example, the apparatus 100 may comprise an optional attachment base 200, two optional fastener apertures 18, and an optional face plate 300.

In some embodiments, the cover face 11 may comprise a generally planar shape as shown in FIG. 1. In alternative embodiments, the cover face 11 may be ornamental or decorative in shape and may optionally comprise one or more engravings, finishes, indicia, graphics, logos, real or simulated gemstones, semi-precious or precious metals and materials, light or sound emitting devices, or any other ornamental or decorative design, technological advancements such as microphones, audio/visual, cell phone and other communication devices, NFC devices, chips, processors, batteries, solar cells, GPS locators, gyroscopes to detect sudden movement of defensive action for security, or any other technological electronic device. It should be understood to one of ordinary skill in the art that the cover face 11, attachment base 200, and face plate 300 may be a plurality of sizes and shapes including square shaped, rectangular shaped, cylinder shaped, cuboid shaped, hexagonal prism shaped, triangular prism shaped, or any other geometric or non-geometric shape. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention.

Additionally, a cover face 11 and/or a cover sidewall 12 may be configured to receive and secure an attachment base 200. An attachment base 200 may comprise one or more attachment base sidewalls 211 which may be joined to an attachment base face 212. In preferred embodiments, an attachment base 200 may comprise a first base sidewall 211 and a second opposing base sidewall 211 wherein the first and second base sidewalls 211 may be mounted over a first cover sidewall 12 and a second opposing cover sidewall 12. In some embodiments, the attachment base face 212 may comprise a generally planar shape as shown in FIG. 1. In alternative embodiments, the attachment base face 212 may be ornamental or decorative in shape and may optionally comprise one or more engravings, finishes, indicia, graphics, logos, real or simulated gemstones, semi-precious or precious metals and materials, light or sound emitting devices, or any other ornamental or decorative design, technological advancements such as microphones, audio/visual, cell phone and other communication devices, NFC devices, chips, processors, batteries, solar cells, GPS locators, gyroscopes to detect sudden movement of defensive action for security, or any other technological electronic device.

The attachment base 200 may be coupled, secured, or joined to one or more optional fastener apertures 18 positioned on the cover face 11 or anywhere on the apparatus 100. In some embodiments, an attachment base 200 may be temporarily joined to a cover face 11 and/or a cover sidewall 12 by being press fit or snap fit together, by one or more fasteners such as Velcro type fasteners, sealable tongue and groove fasteners, clip type fasteners, clasp type fasteners, ratchet type fasteners, magnet type fasteners, threaded type fasteners such as screws and bolts, buckle type fasteners and the like, or any other suitable joining method capable of temporarily securing portions of an attachment base 200 to a cover face 11 and/or a cover sidewall 12. In other embodiments, an attachment base 200 may be substantially permanently coupled, secured, or joined to cover face 11 and/or a cover sidewall 12 with heat bonding, chemical bonding, adhesives, clasp type fasteners, clip type fasteners, rivet type fasteners, threaded type fasteners, other types of fasteners, by being integrally molded or formed together, or any other suitable joining method capable of substantially permanently securing portions of an attachment base 200 to cover face 11 and/or a cover sidewall 12.

In further embodiments, one or more face plates 300 may be received and secured by an attachment base 200 and/or the cover face 11 over or above the cover face 11. In other embodiments, a face plate 300 may be mounted or joined within or to an attachment base 200 and the attachment base 200 may be coupled, secured, or joined to the button cover apparatus 100. The face plate 300 may be ornamental or decorative in shape and may optionally comprise one or more engravings, finishes, indicia, graphics, logos, real or simulated gemstones, semi-precious or precious metals and materials, light or sound emitting devices, or any other ornamental or decorative design, technological advancements such as microphones, audio/visual, cell phone and other communication devices, NFC devices, chips, processors, batteries, solar cells, GPS locators, gyroscopes to detect sudden movement of defensive action for security, or any other technological electronic device. A face plate 300 may be coupled, secured, mounted, or joined to an attachment base 200 and/or the cover face 11 by any suitable permanent or temporary joining method similar to those capable of securing portions of an attachment base 200 to cover face 11 and/or a cover sidewall 12 as discussed above.

In preferred embodiments, a plurality of decorative or ornamental face plates 300 and/or attachment bases 200 may be permanently secured to the button cover apparatus 100 by the manufacturer providing a durable look and style for button cover apparatuses 100 to endure the wear and tear associated with being worn on the user's clothing or accessories. In alternative embodiments, a plurality of decorative or ornamental face plates 300 and/or attachment bases 200 may be temporarily and interchangeably secured to the button cover apparatus 100 allowing the user to change the look and style of one or more button cover apparatuses 100 worn on the user's clothing or accessories.

Figure 2:
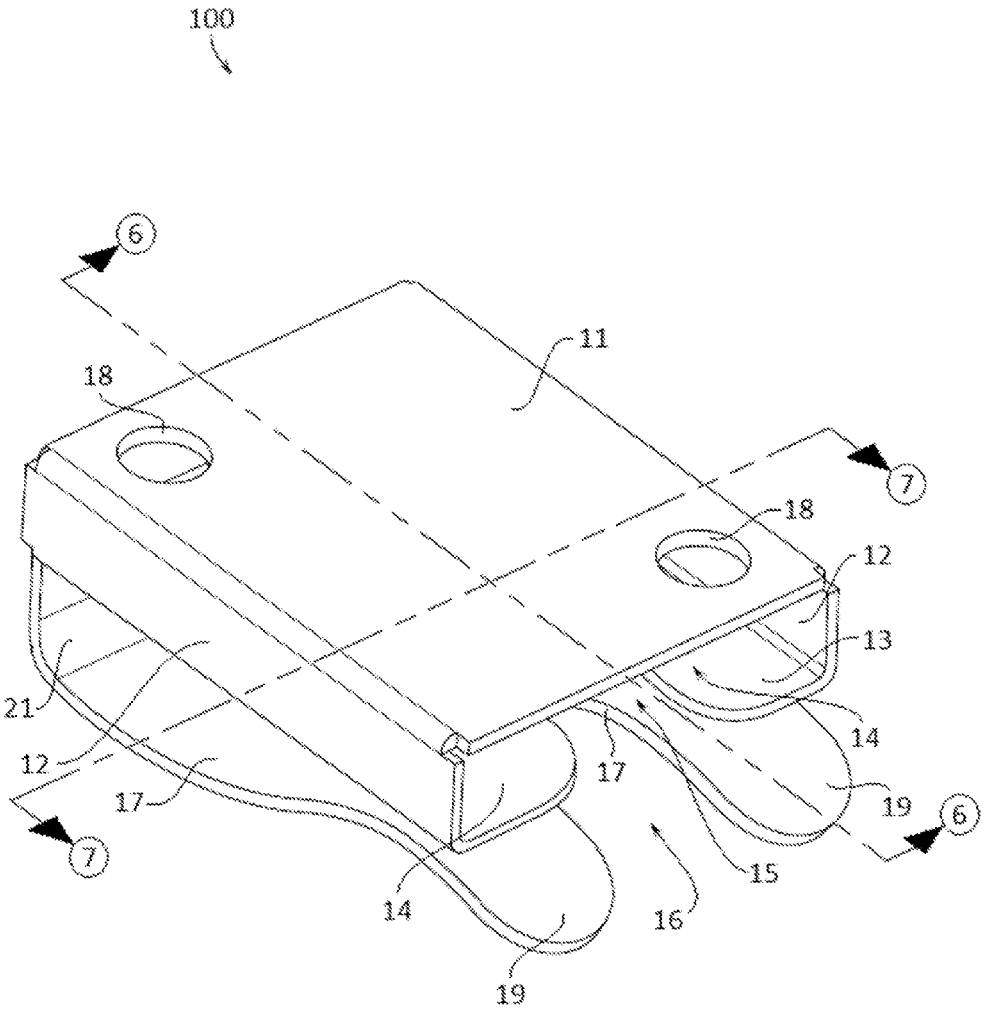
FIG. 2 illustrates a top perspective view of an example of a button cover apparatus according to various embodiments described herein.

FIG. 2 illustrates a top perspective view of an example of a button cover apparatus 100 according to various embodiments described herein. In this embodiment, the apparatus 100 comprises a cover face 11 with a first clip arm 17 connected to the cover face 11 and a second clip arm 17 connected to the cover face 11. A clip channel 16 is located between the first clip arm 17 and the second clip arm 17 with a cover channel 15 located parallel to the clip channel 16 and below the cover face 11. Preferably, the cover face 11 may be joined to two opposite and parallel cover sidewalls 12. A third cover sidewall 12 may be joined to the cover face 11 and may be perpendicularly joined to the two parallel cover sidewalls 12. In preferred embodiments, the cover sidewalls 12 may be planar in shape and joined perpendicularly to the cover face 11. In other embodiments, one or more cover sidewalls 12 may be curved or angular and may be joined to the cover face 11 at acute or obtuse angles.

In the embodiment depicted in FIG. 2, the apparatus 100 also comprises a button arm 13 joined to each of the two opposite and parallel cover sidewalls 12. In preferred embodiments, the apparatus 100 may comprise a first button arm 13 extending inwardly from a first cover sidewall 12 towards the cover channel 15 and a second button arm 13 extending inwardly from a second cover sidewall 12, generally opposite and parallel to the first cover sidewall 12, towards the cover channel 15. In other embodiments, each cover sidewall 12 may be joined to a button arm 13. In preferred embodiments, the button arms 13 may be planar in shape and joined perpendicularly to a cover sidewall 12 and generally parallel to the cover face 11. In other embodiments, one or more button arms 13 may be curved or angular and may be joined to a cover sidewall 12 at acute or obtuse angles.

Figure 5:
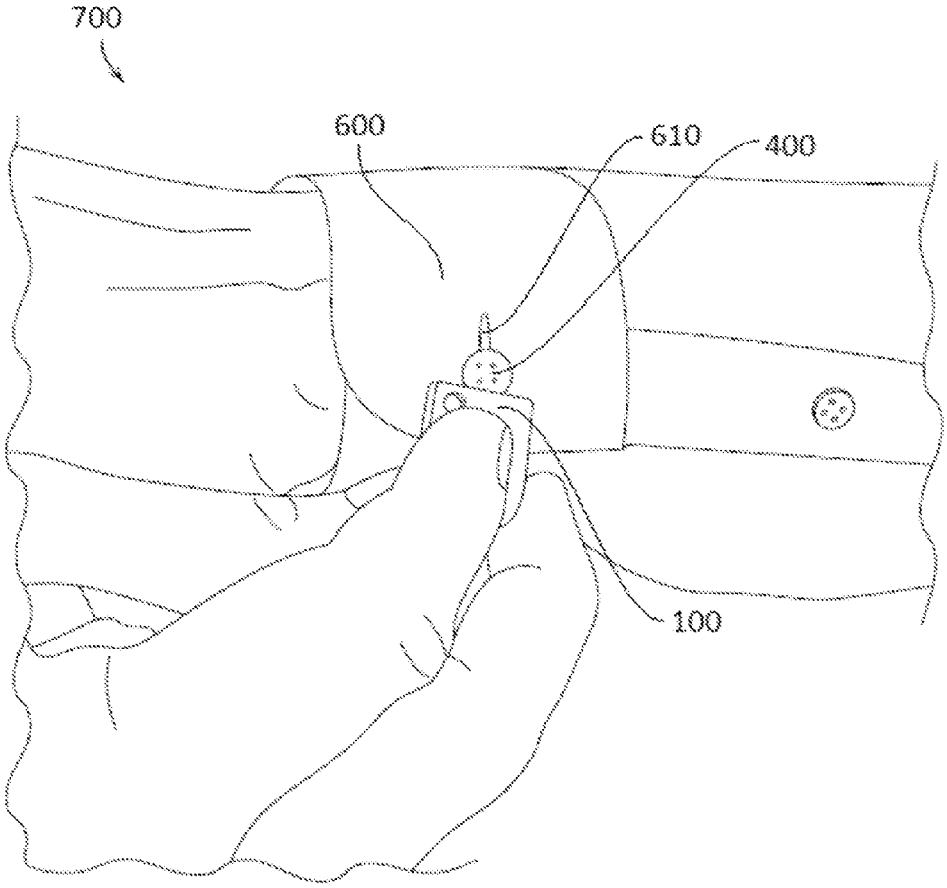
FIG. 5 illustrates a perspective view of a user securing an example of a button cover apparatus to a button on a sleeve according to various embodiments described herein.
Figure 6:
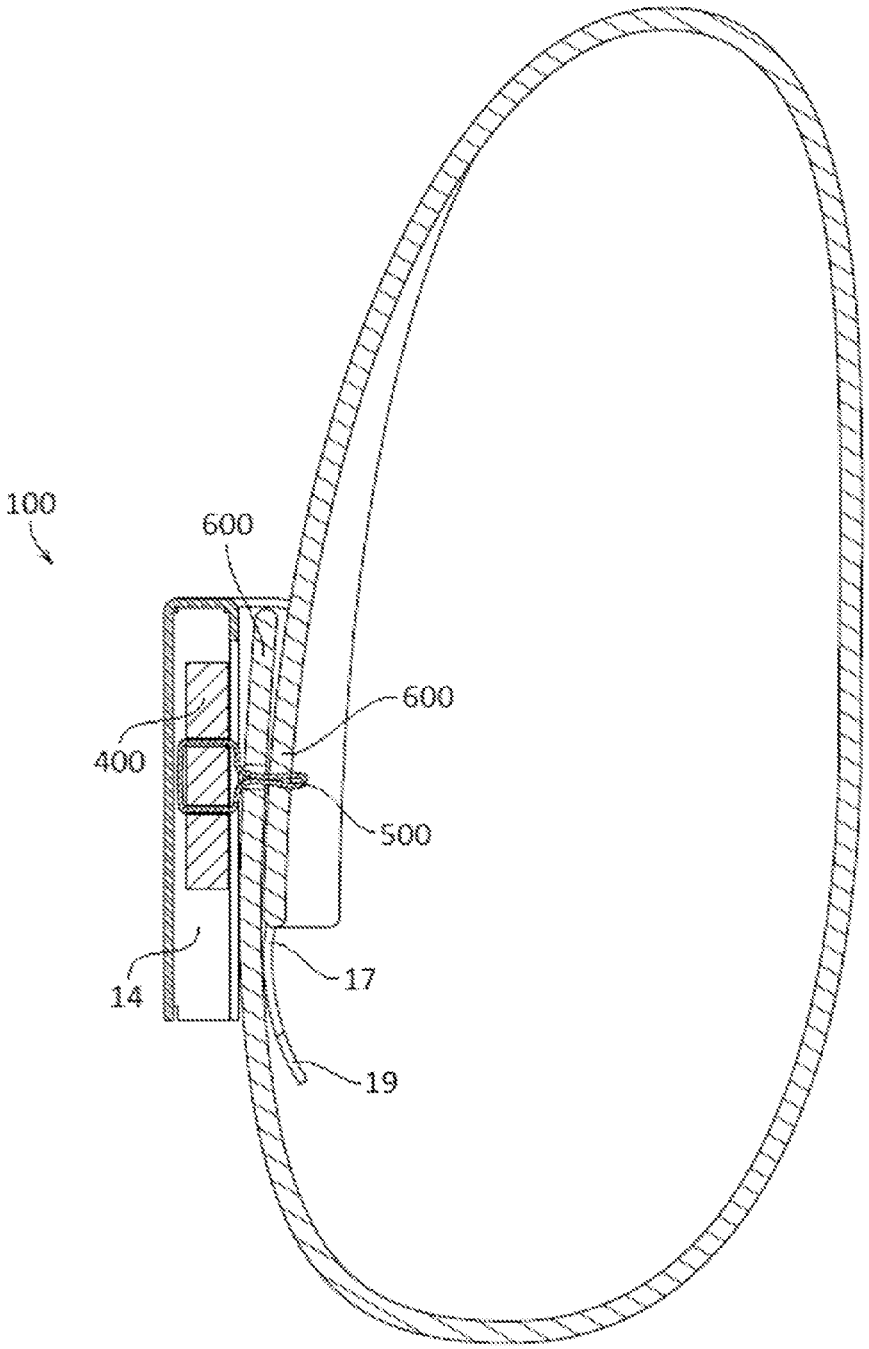
FIG. 6 shows a sectional, through line 6-6 shown in FIG. 2, elevation view of an example of a button cover apparatus secured to a button and to a button substrate according to various embodiments described herein.
Figure 7:
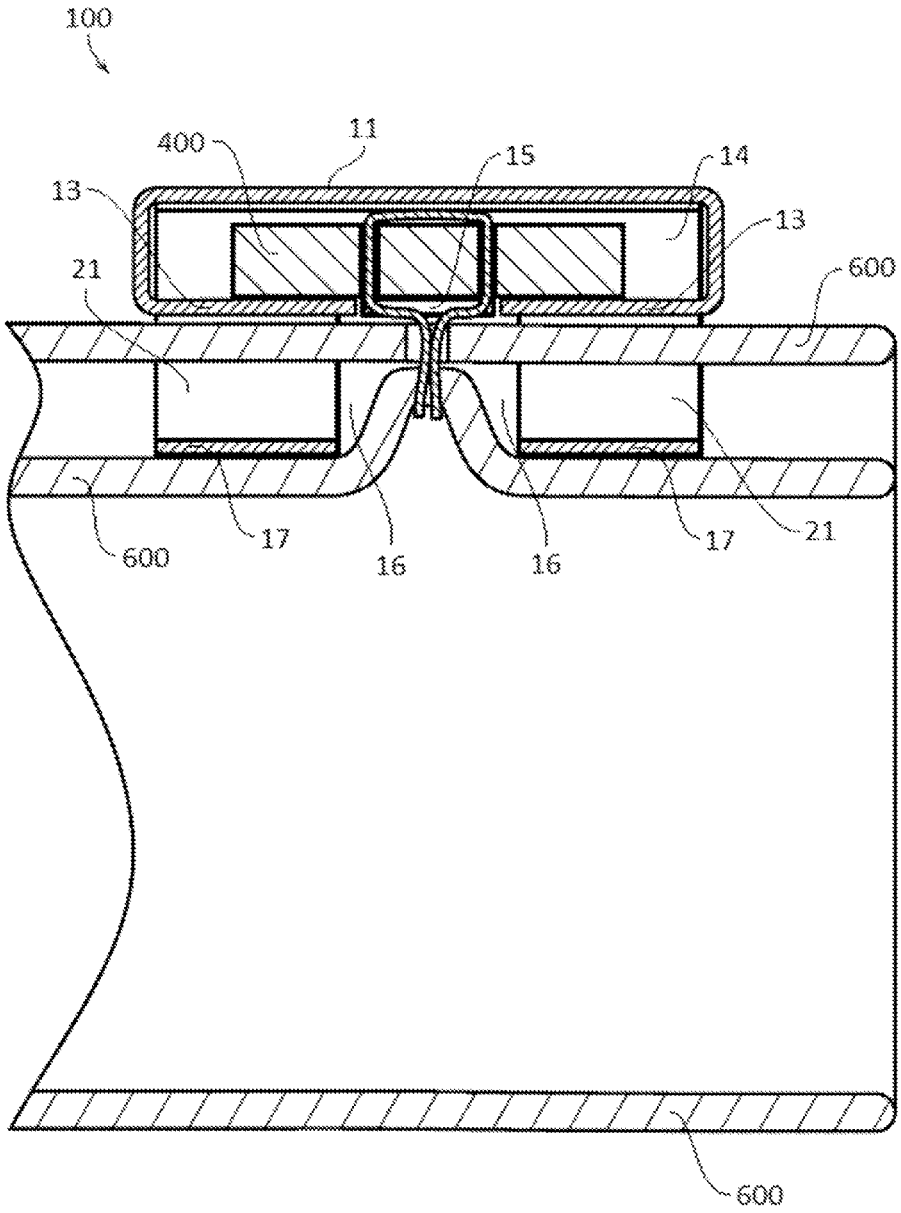
FIG. 7 depicts a sectional, through line 7-7 shown in FIG. 2, elevation view of an example of a button cover apparatus secured to a button and to a button substrate according to various embodiments described herein.

Also in preferred embodiments, the button arms 13 joined to the two opposite and parallel cover sidewalls 12 are not configured to meet in the center thereby forming a cover channel 15 between the button arms 13 that is able to slidably receive the button string 500 (FIGS. 6 and 7) that is used to secure a button 400 (FIGS. 5-7) to a garment, accessory, or other type of button substrate 600 (FIGS. 5-7). In other embodiments in which a button arm 13 may be joined to a cover sidewall 12 that is perpendicular to the two opposite and parallel cover sidewalls 12, the third button arm 13 may be configured to stop the front to back sliding motion of a button string 500 (FIGS. 6 and 7) that is slidably received in the cover channel 15. The button arms 13 may comprise rounded edges to prevent damage to the button string 500 (FIGS. 6 and 7) of the button 400 (FIGS. 5-7) to which the apparatus 100 is slidably engaged to.

A button arm 13 may be substantially permanently joined to a cover sidewall 12 with heat bonding, chemical bonding, adhesives, clasp type fasteners, clip type fasteners, rivet type fasteners, threaded type fasteners, other types of fasteners, by being integrally molded or formed together, or any other suitable joining method capable of substantially permanently securing portions of a button arm 13 to a cover sidewall 12.

The cover sidewalls 12 are configured to position the button arms 13 away from the cover face 11 thereby forming a button cavity 14 that is able to receive a button on a garment, accessory, or other type of button substrate 600 (FIGS. 5-7). The apparatus 100 preferably comprises a first cover sidewall 12 and a second cover sidewall 12, both of which extending longitudinally below opposing sides of the cover face 11. In preferred embodiments, a button cavity 14 may be bounded and formed by the cover face 11, two or more cover sidewalls 12, and two or more button arms 13. In further preferred embodiments, a first cover sidewall 12 joined to a first button arm 13, a second cover sidewall 12 joined to a second button arm 13 which oppose the first cover sidewall 12 and first button arm 13, and cover channel 15 form a button cavity 14 configured to slidably receive and engage a button 400 (FIGS. 5-7) while one or more clip arms 17 are configured to slidably receive and engage a button substrate 600 (FIGS. 5-7).

By sliding the button 400 (FIGS. 5-7) into the button cavity 14 and sliding its respective button string 500 (FIGS. 6 and 7) into the cover channel 15 and into the clip channel 16, a button 400 (FIGS. 5-7) may be temporarily and slidably engaged within the apparatus 100.

Figure 3:
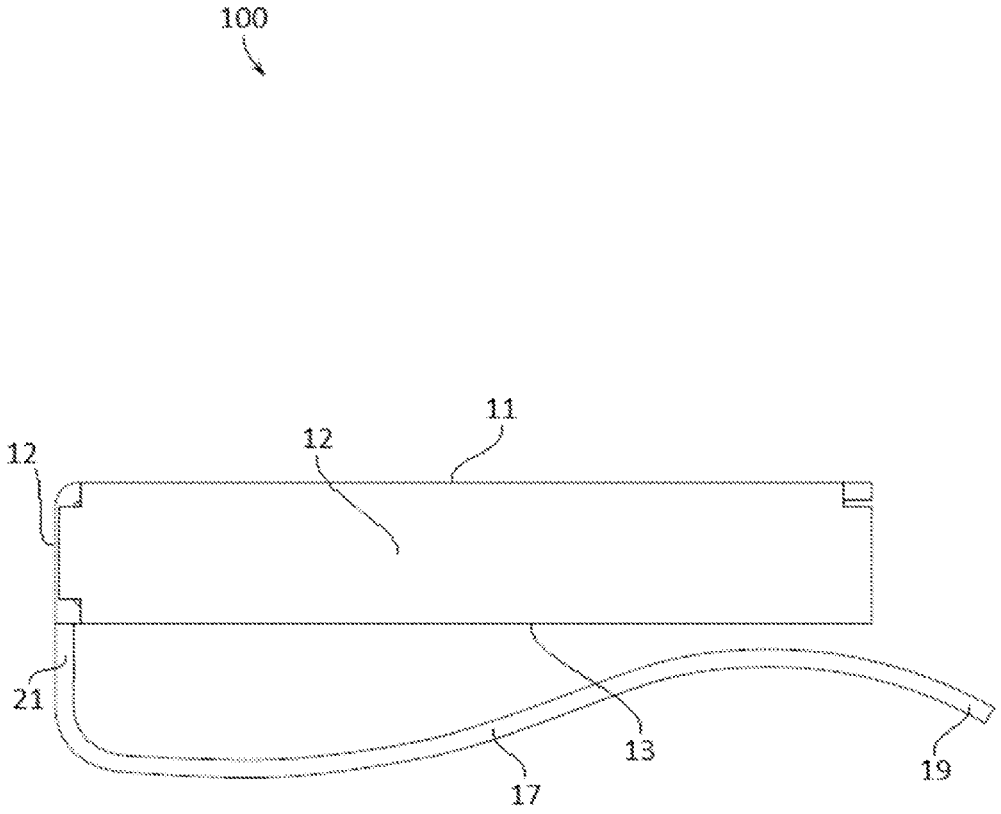
FIG. 3 shows a side elevation view of an example of a button cover apparatus according to various embodiments described herein.

Turning now to FIG. 3, a side elevation view of an example of a button cover apparatus 100 according to various embodiments described herein is shown. In this example, a clip arm 17 can be seen joined to one or more of the cover sidewalls 12, cover face 11, and/or button arms 13 by a clip support 21. In preferred embodiments, a clip arm 17 may comprise a clip support 21 configured to maintain the position of a clip arm 17 relative to the cover sidewalls 12 and the button arms 13, and the clip arm 17 may terminate in a receiving lip 19 which may serve to guide the slidable engagement of the apparatus 100 with a button substrate 600 (FIGS. 5-7). The clip arm 17 and/or the receiving lip 19 may comprise one or more rounded, beveled, or smoothed edges to prevent damage to a button substrate 600 (FIGS. 5-7) during slidable engagement. Also in preferred embodiments, a receiving lip 19 may be configured at an obtuse angle away from a button arm 13 to allow the button cover apparatus 100 to be slidably engaged with the button substrate 600 (FIGS. 5-7).

The clip arms 17 are configured to receive and frictionally secure portions of a button substrate 600 (FIGS. 5-7) between portions of the clip arm 17 and portions of one or more of the cover sidewalls 12 and/or the button arms 13. In order to facilitate the frictional securement, portions of a clip arm 17, preferably closer to a receiving lip 19, may be configured to contact or be positioned closer to a cover sidewall 12 and/or a button arm 13, while other portions of a clip arm 17, preferably closer to a clip support 21, may be configured to not contact or be positioned relatively further from a cover sidewall 12 and/or a button arm 13. By configuring portions of a clip arm 17 to contact or be positioned closer to a cover sidewall 12 and/or a button arm 13, these portions of the clip arm 17 may be configured to apply pressure to a button substrate 600 (FIGS. 5-7) adjacent to a button 400 (FIGS. 5-7) temporarily holding or securing the button cover apparatus 100 in place over a button 400 (FIGS. 5-7).

The clip support 21 may be substantially permanently joined to a cover sidewall 12 and/or a button arm 13 with heat bonding, chemical bonding, adhesives, clasp type fasteners, clip type fasteners, rivet type fasteners, threaded type fasteners, other types of fasteners, by being integrally molded or formed together, or any other suitable joining method capable of substantially permanently securing portions of a cover sidewall 12 and/or a button arm 13. In other embodiments, the clip support 21 may be substantially permanently pivotally joined to a cover sidewall 12 and/or a button arm 13 with a butt hinge, butterfly hinge, flush hinge, barrel hinge, concealed hinge, continuous hinge, T-hinge, strap hinge, double-acting hinge, Soss hinge, a flexible material hinge, or any other type or style of hinge including spring loaded hinges.

Figure 4:
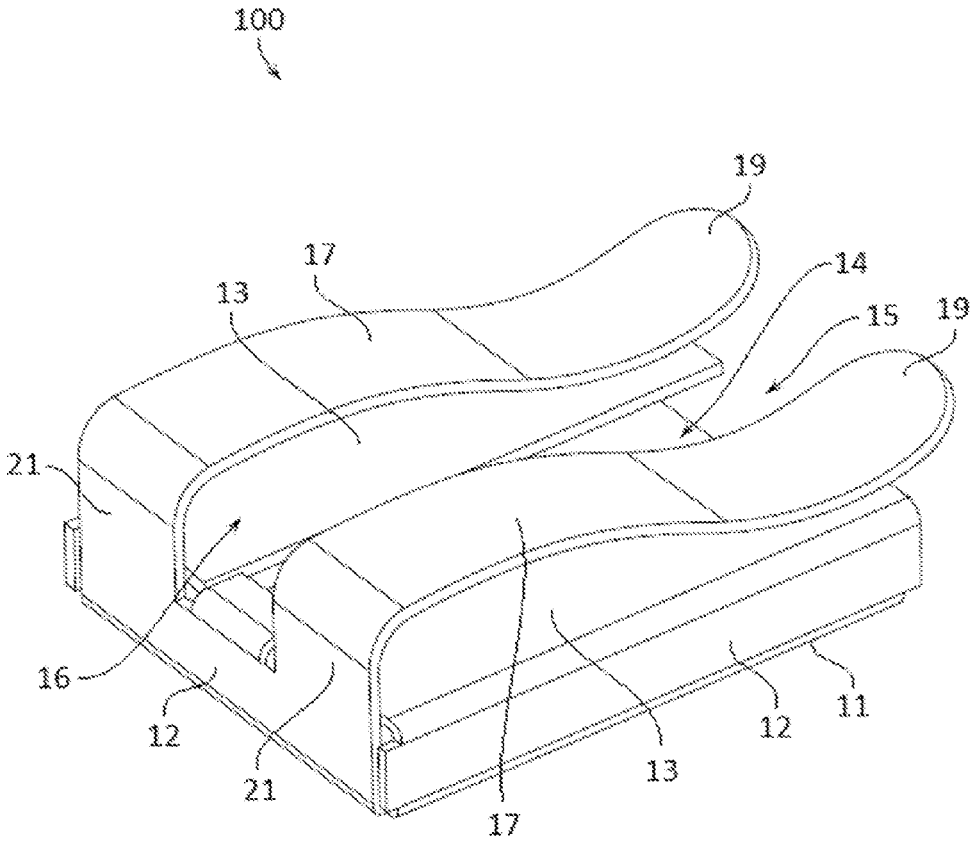
FIG. 4 depicts a bottom perspective view of an example of a button cover apparatus according to various embodiments described herein.

FIG. 4 depicts a bottom perspective view of an example of a button cover apparatus 100 according to various embodiments described herein. In this figure of a preferred embodiment, two clip arms 17 are joined to one or more of the cover sidewalls 12 and/or button arms 13 by their respective clip support 21. The space between the two clip arms 17 forms the clip channel 16 into which the button string 500 (FIGS. 6 and 7) may be slidably engaged. Additionally, the space between the button arms 13 forms the cover channel 15 into which the button string 500 (FIGS. 6 and 7) may also be slidably engaged.

As perhaps best shown by FIG. 5, a perspective view of a user 700 securing an example of a button cover apparatus 100 to a button 400 on a shirt sleeve type of button substrate 600 according to various embodiments described herein is shown. In this and preferred embodiments, a button cover apparatus 100 may be slidably engaged to a button 400 and a button substrate 600 by sliding the button substrate 600 comprising the button hole 610 between the clip arms 17 (FIGS. 1-4) and the button arms 13 (FIGS. 1-4) and/or cover sidewalls 12 (FIGS. 1-4), while simultaneously sliding the button string 500 (FIGS. 6 and 7) into the clip channel 16 (FIGS. 1, 2, and 4) and into the cover channel 15 (FIGS. 1, 2, and 4). Additionally, the button 400 is simultaneously slid into the button cavity 14 (FIGS. 1-4) as the button string 500 (FIGS. 6 and 7) is slid into the clip channel 16 (FIGS. 1, 2, and 4) and into the cover channel 15 (FIGS. 1, 2, and 4). By securing the button 400 and the button substrate 600 comprising the button hole 610, the apparatus 100 is able to cover a button 400 while preventing the button 400 from being torn off of the button substrate 600 should the apparatus 100 catch or snag on an object thereby preventing the loss of the apparatus 100 and its respective button 400.

FIG. 6 shows a sectional, through line 6-6 shown in FIG. 2, elevation view of an example of a button cover apparatus 100 secured to a button 400 and to a button substrate 600 according to various embodiments described herein. In this sectional side view, the apparatus 100 is engaged to the button 400 and to the button substrate 600 by sliding the receiving lip 19 of the clip arm 17 between the button substrate 600 comprising the button hole 610 (FIG. 5) between the button substrate 600 to which the button 400 is attached while sliding the button 400 into the button cavity 14 and the button string 500 into the cover channel 15 (FIGS. 1, 2, 4, and 7) and into the clip channel 16 (FIGS. 1, 2, 4, and 7). The button cover apparatus 100 may be slidably disengaged from the button 400 and/or the button substrate 600 by sliding the clip arms 17 out from between the button substrate 600 to which the button 400 is attached while sliding the button 400 out of the button cavity 14 and the button string 500 out of the cover channel 15 (FIGS. 1, 2, 4, and 7) and out of the clip channel 16 (FIGS. 1, 2, 4, and 7).

Turning now to FIG. 7, a sectional, through line 7-7 shown in FIG. 2, elevation view of an example of a button cover apparatus 100 secured to a button 400 and to a button substrate 600 according to various embodiments described herein is depicted. In this figure, the slidable engagement of the apparatus 100 over the button 400 and the button substrate 600 is perhaps best shown. By sliding the clip arms 17 between the button substrate 600 comprising the button 400 and the button substrate 600 comprising the button hole 610, the clip arms 17 are able to frictionally secure or grip the button cover substrate 600. As the clip arms 17 are slid between the button substrate 600 comprising the button 400 and the button substrate 600 comprising the button hole 610 (FIG. 5), the button 400 is received into the button cavity 14 while the button string 500 is received into the cover channel 15 and the clip channel 16, thereby slidably engaging the apparatus 100 over the button 400 and the button substrate 600.

In some embodiments, portions of a clip arm 17 may comprise friction enhancing textures such as ribs, grooves, bumps, and the like. In other embodiments, portions of a clip arm 17 may comprise friction enhancing materials such as rubber, silicone, soft plastics, and other similar friction enhancing materials. In preferred embodiments, the elements that comprise the apparatus 100 may be made from durable materials such as hard plastics, metal alloys, wood, hard rubbers, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A button cover configured to be slidably engaged over a button and button substrate, the button cover comprising:

a. a cover face comprising a first cover sidewall and a second cover sidewall extending below the cover face;

b. a first clip arm connected to the cover face;

c. a second clip arm connected to the cover face;

d. a clip channel located between said first clip arm and said second clip arm;

e. an attachment base comprising a first base sidewall and a second opposing base sidewall wherein said first and second base sidewalls are mounted over said first cover sidewall and said second cover sidewall of the cover face;

f. a faceplate mounted within an attachment base coupled to the button cover above the cover face; and wherein the first and second clip arms are configured to apply pressure to the button substrate temporarily holding the button cover in place over a button.

2. The button cover of claim 1 wherein the first cover sidewall and a second cover sidewall extend longitudinally below opposing sides of the cover face.

3. The button cover of claim 2 further comprising a first button arm extending inwardly from the first cover sidewall towards a cover channel and a second button arm extending inwardly from the second cover sidewall towards the cover channel.

4. The button cover of claim 3 wherein the first cover sidewall, second cover sidewall, first button arm, second button arm, and cover channel form a button cavity configured to receive a button while attached to a button substrate, said button cavity positioned above said clip channel and below the cover face.

5. The button cover of claim 4 wherein the first clip arm and second clip arm each terminate with a receiving lip.

6. The button cover of claim 5 wherein the receiving lip is configured at an obtuse angle away from the button arm to allow the button cover to be slidably engage with the button substrate.

7. The button cover of claim 6 wherein the cover face comprises a fastener aperture.

8. The button cover of claim 1 wherein the first clip arm and second clip arm each terminate with a receiving lip.

9. The button cover of claim 1 wherein the faceplate contains an ornamental design.

10. The button cover of claim 1 wherein the faceplate is removably coupled to the attachment base.

11. The button cover of claim 1 wherein the faceplate contains an ornamental design or a technological device.

* * * * *